US008733624B2

(12) United States Patent
Rueda

(10) Patent No.: US 8,733,624 B2
(45) Date of Patent: May 27, 2014

(54) CARDBOARD PACKAGE WITH A FOOD PRODUCT

(75) Inventor: Luis Fernando Rueda, Andar (BR)

(73) Assignee: Nestec S.A., Vevey (CH)

( * ) Notice: Subject to any disclaimer, the term of this patent is extended or adjusted under 35 U.S.C. 154(b) by 1190 days.

(21) Appl. No.: 11/993,193

(22) PCT Filed: Jun. 30, 2006

(86) PCT No.: PCT/EP2006/006349
§ 371 (c)(1),
(2), (4) Date: Dec. 19, 2007

(87) PCT Pub. No.: WO2007/003356
PCT Pub. Date: Jan. 11, 2007

(65) Prior Publication Data

US 2010/0276479 A1 Nov. 4, 2010

(30) Foreign Application Priority Data

Jul. 1, 2005 (EP) ..... 05105996

(51) Int. Cl.
*B65D 5/66* (2006.01)

(52) U.S. Cl.
USPC ..... 229/126; 229/149

(58) Field of Classification Search
USPC ..... 229/125.28, 149, 222, 232, 125.09, 229/221, 224, 225, 226, 233, 234, 125.11, 229/131.1, 141; 206/245, 247, 251, 253, 206/258, 261, 270
See application file for complete search history.

(56) References Cited

U.S. PATENT DOCUMENTS

| | | | | |
|---|---|---|---|---|
| 2,317,269 | A * | 4/1943 | Hammarstrom | 229/125.02 |
| 2,436,553 | A * | 2/1948 | Couch et al. | 229/122 |
| 2,683,561 | A * | 7/1954 | Rice | 229/117.01 |
| 2,777,630 | A * | 1/1957 | Moberger | 229/125.28 |
| 3,185,377 | A | 5/1965 | Moore | |
| 4,004,692 | A * | 1/1977 | Burns | 206/486 |
| 4,062,486 | A | 12/1977 | Goodrich | |
| 6,702,108 | B2 * | 3/2004 | Lo Duca | 206/232 |
| 7,731,024 | B2 * | 6/2010 | Bouno et al. | 206/268 |
| 2004/0074956 | A1 | 4/2004 | Sax et al. | |

FOREIGN PATENT DOCUMENTS

| | | |
|---|---|---|
| BE | 490498 | 8/1949 |
| GB | 925975 | 5/1963 |

* cited by examiner

*Primary Examiner* — Gary Elkins
*Assistant Examiner* — Christopher Demeree
(74) *Attorney, Agent, or Firm* — K&L Gates LLP

(57) ABSTRACT

The present invention relates to a single-layer cardboard package (1) for food products comprising a front panel (2), a back panel (3), four side panels (4), said front panel comprising precuts (5) defining an openable portion (2*a*) of the front panel and a non-openable portion (2*b*) of said front panel, characterized in that: (i) the non-openable portion of said front panel further comprises a locking slot (6), and (ii) a locking element (7) is fixed onto the openable portion (2*a*) of said front panel so as to extend its length, said element (7) comprising a tongue portion (8) to be inserted into said locking slot (6) to lock said openable portion (2*a*) in the closed position.

9 Claims, 5 Drawing Sheets

CARDBOARD PACKAGE WITH A FOOD PRODUCT

The present invention relates to a package, especially a package for a food product having a rectangular block shape, such as a chocolate tablet for example.

In the following description, the term "wrap-around" pack will be used, which shall be considered as an equivalent to "envelope" pack.

Standard so-called "wrap-around" equipment for packing foiled tablets into carton board packs produces a pack which is not truly re-sealable and opened by a small side, like for example usual medicine cardboard packs.

In the tablet packs using this standard equipment, foil is folded around the tablet and then cardboard is folded around the tablet. The cards used are single sheets with perforations and fold lines. Once the consumer has opened the extra flap on the pack by breaking the die-cut perforations, there is no overlap to allow re-sealing.

Carton board packs exist with more complex multi-layer structures which would allow true re-sealing. However, these more complex packs are formed and erected before the wrapped tablet is inserted thereinto. This requires two separate operations: first, a wrapping machine is used for wrapping the inner pack, and second, a cartonning machine is used for erecting and filling the carton box with the wrapped tablet. Therefore, as can be understood, such tablets packaged into complex packs could not be manufactured on a conventional wrap-around packing line combining foiling and carton board packing.

Therefore, a need exists for a tablet cardboard packaging that can be produced with a standard foiling and cardboard-wrapping equipment as described above, said packaging being reclosable after the first opening.

The present invention addresses the problems set out above with a single-layer cardboard package for food products comprising a front panel, a back panel, four side panels, said front panel comprising precuts defining an openable portion of the front panel and a non-openable portion of said front panel, characterized in that:

(i) the non-openable portion of said front panel further comprises a locking slot, and (ii) a locking element is fixed onto the openable portion of said front panel so as to extend its length, said element comprising a tongue portion to be inserted into said locking slot to lock said openable portion in the closed position.

In a highly preferred embodiment of the present invention, the locking element is a cardboard flat panel that is glued onto the openable portion of the front panel.

Preferably, the openable portion of said front panel is pivotable around the edge located between said openable portion and the adjacent side panel, said edge acting as a hinge.

Furthermore, said locking element preferably comprises an extension that forms a side panel of said package.

Said locking element preferably has a width that is equal to the width of said front panel.

In a preferred embodiment of the invention, the food product is a chocolate tablet.

Additional features and advantages of the present invention are described in, and will be apparent from, the description of the presently preferred embodiments which are set out below with reference to the drawings in which.

Figure 1:
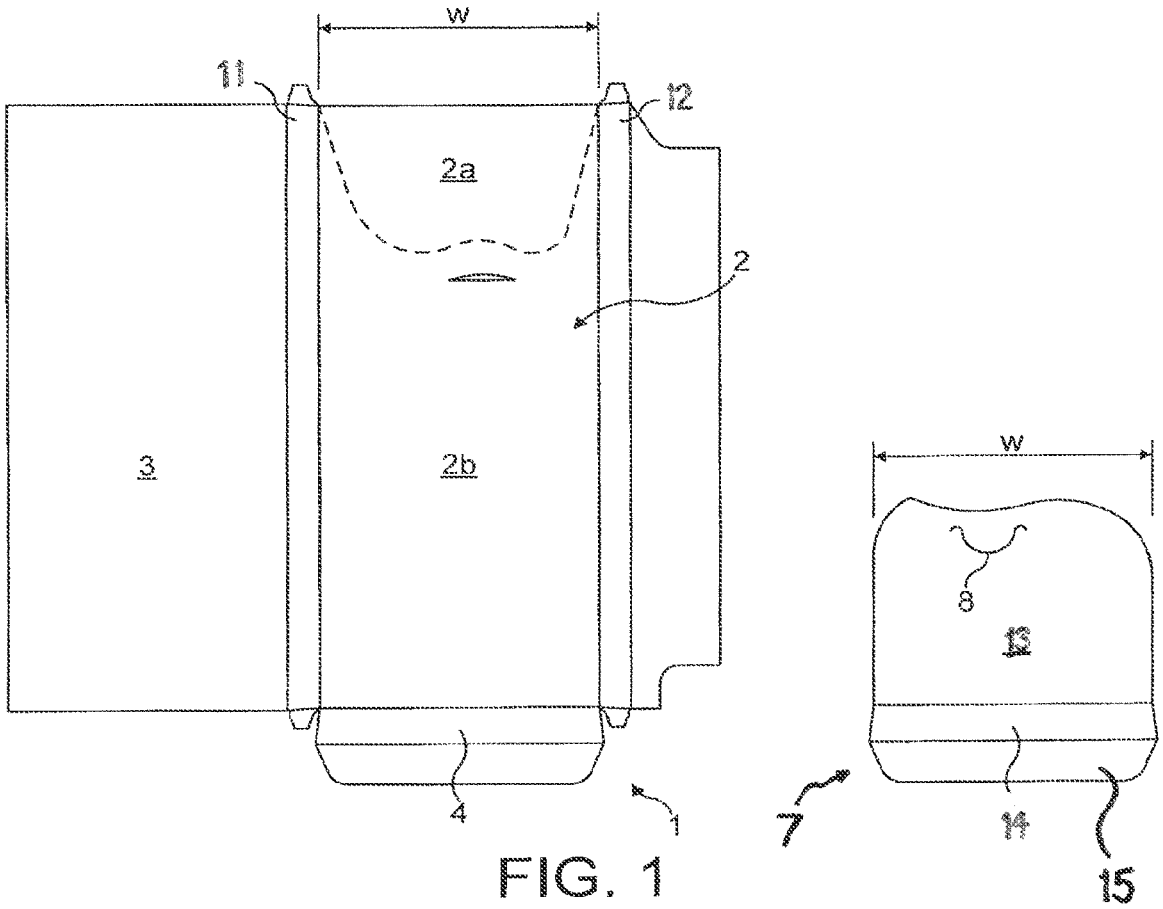
FIG. 1 is a schematic top view showing the two flat carton elements constituting the package of the invention.

As illustrated in FIG. 1, the package 1 according to the present invention is a single-layer cardboard package for chocolate tablet products (tablet not illustrated in the drawings).

It is formed out of a flat cardboard which is erected and formed on a conventional carton forming machine. The flat carton board as shown in FIG. 1 comprises a body 10 comprising a front panel 2, a back panel 3, a bottom side panel 4, a left side panel 11, and a right side panel 12.

The front panel 2 comprises precuts 5 (shown in dotted lines in the drawing) defining an openable portion 2*a* of the front panel and a non-openable portion 2*b* of said front panel 2.

Furthermore and according to the present invention, the non-openable portion 2*b* of said front panel further comprises a locking slot 6. A locking element 7 is provided, and the locking element 7 comprises a front section 13 that is to be glued onto the openable portion 2*a* of said front panel 2 so as to extend its length, as shown in FIG. 2.

Figure 2:
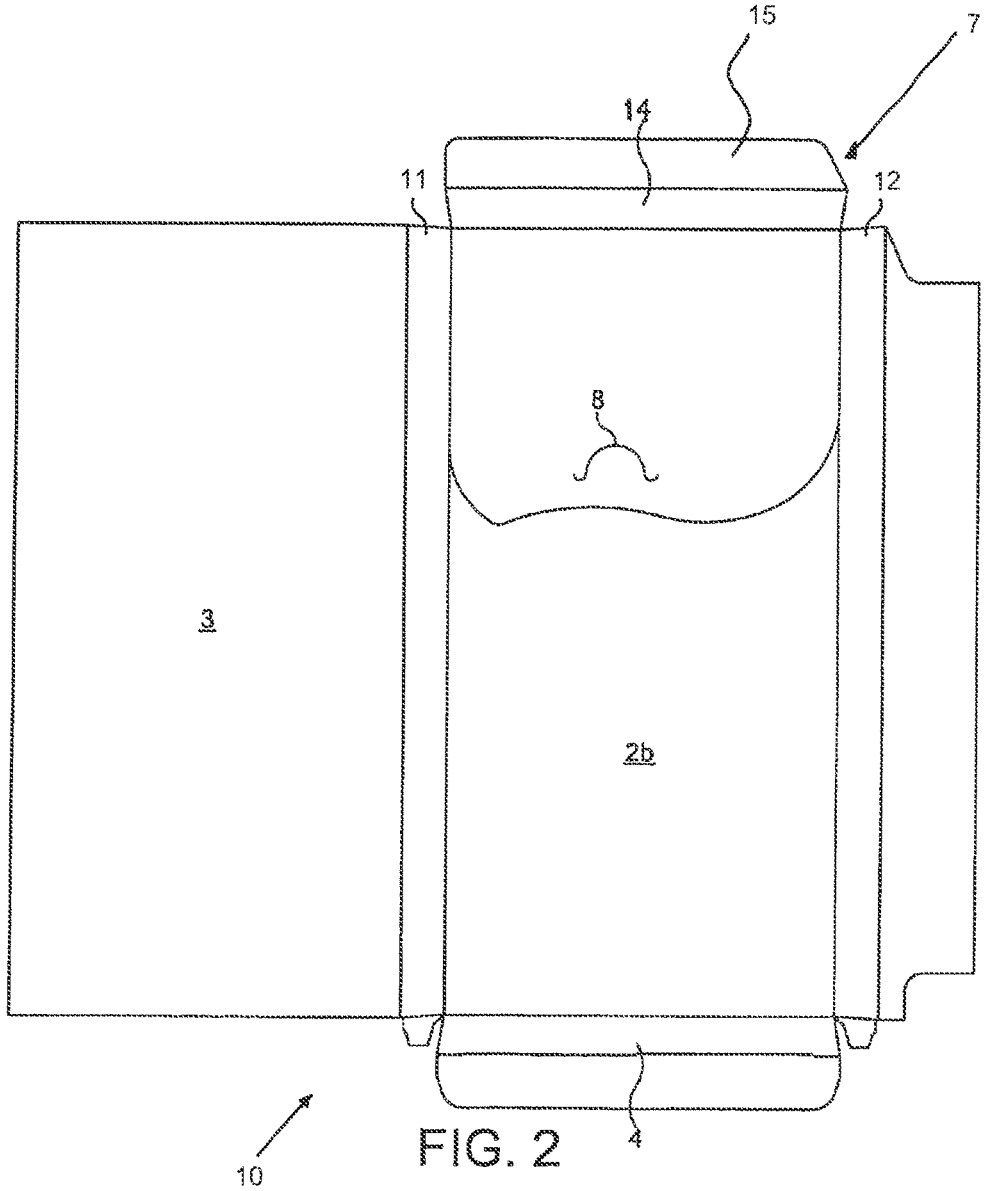
FIG. 2 is a schematic top view similar to FIG. 1, showing the elements of the flat carton glued together.

As shown in FIGS. 1 and 2, said locking element 7 comprises an extension 14 that forms a top side panel of the package 1, and the top side panel is adjacent to the openable portion 2*a* of the front panel 2.

Figure 3:
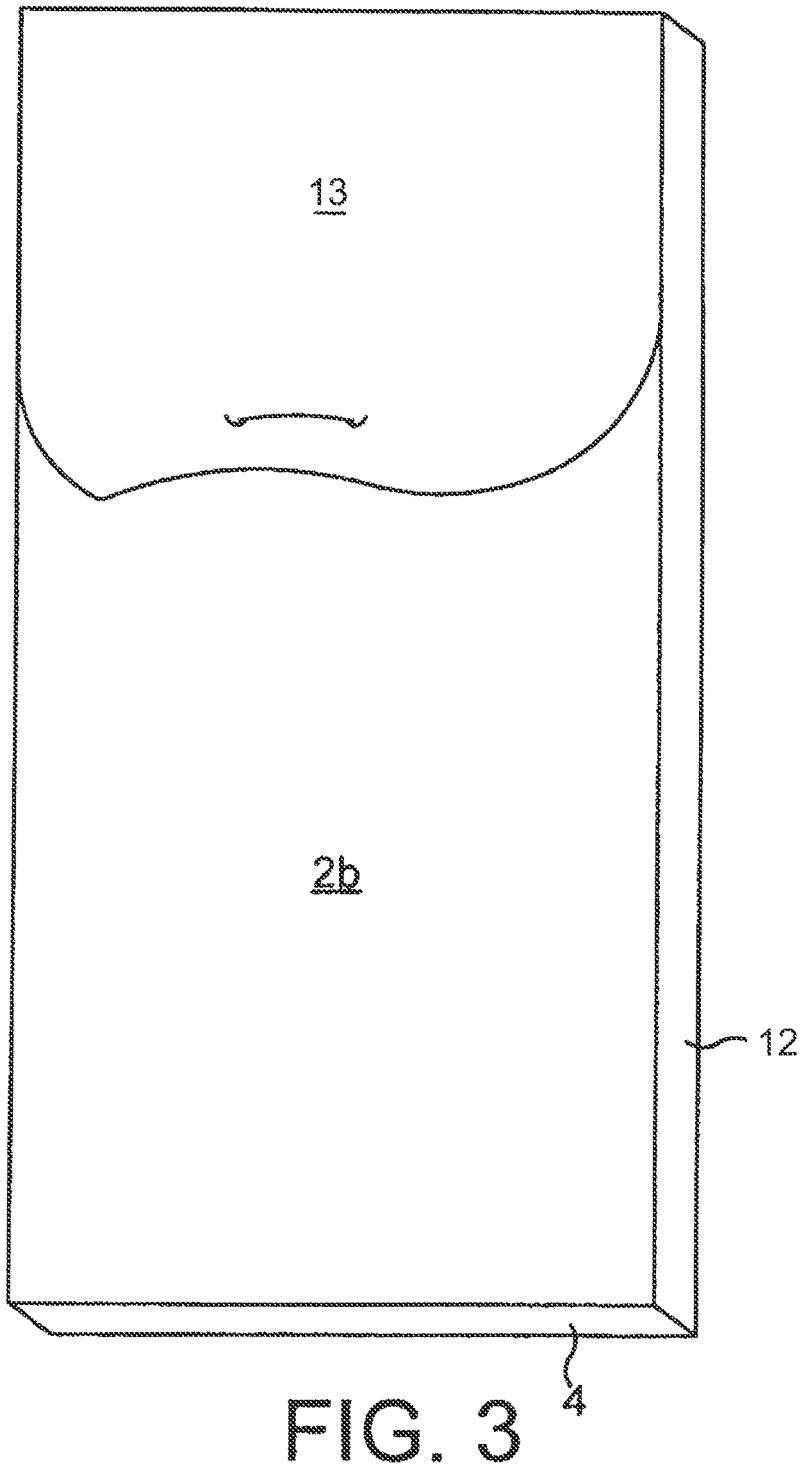
FIG. 3 is a perspective schematic top view of the package of the invention, in the formed configuration, and in the closed position.
Figure 4:
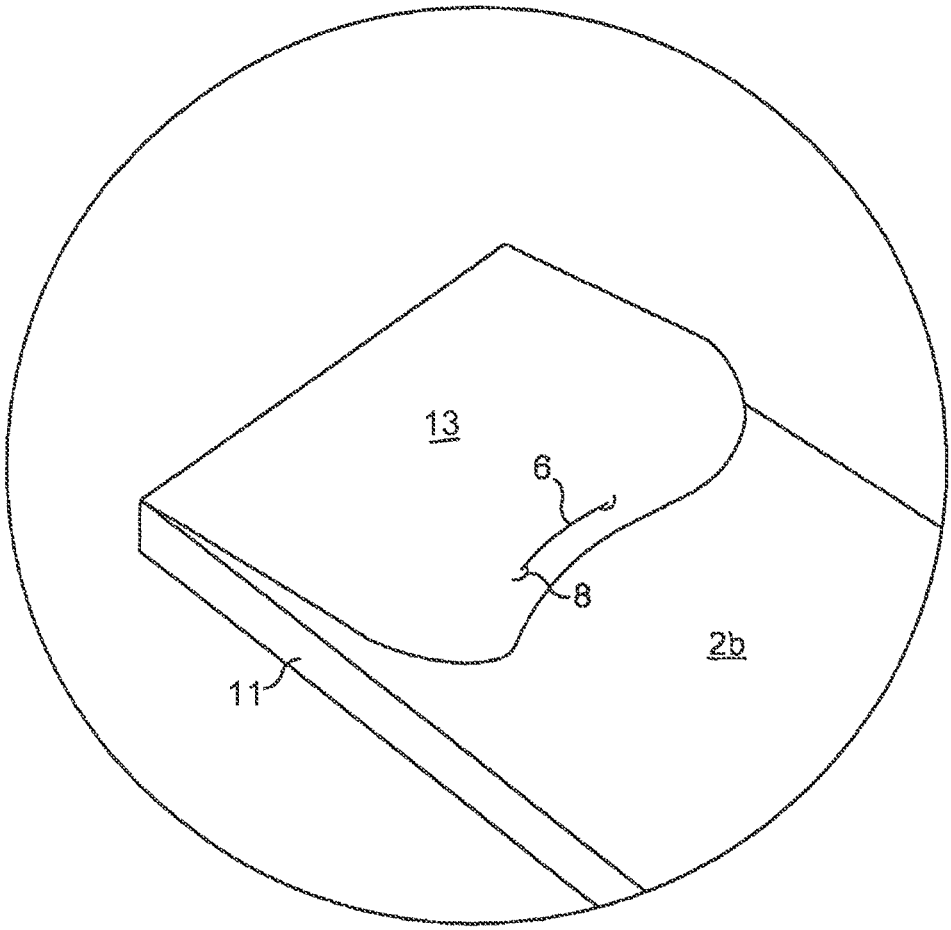
FIG. 4 is a perspective schematic enlarged view of the top portion of the package according to the present invention, in its closed position.

Said locking element 7 comprises a tongue portion 8 to be inserted into the locking slot 6 of the front panel 2, in order to allow locking of the openable portion 2*a* of the front panel, when the package 1 is in its closed position, as shown in FIGS. 3 and 4.

As can be seen in FIG. 2, said locking element 7 has a width w that is equal to the width W of the front panel 2 of the package.

The locking element 7 is a cardboard flat panel that is glued onto the openable portion 2*a* of the front panel, as illustrated in FIGS. 1 and 2.

Figure 5:
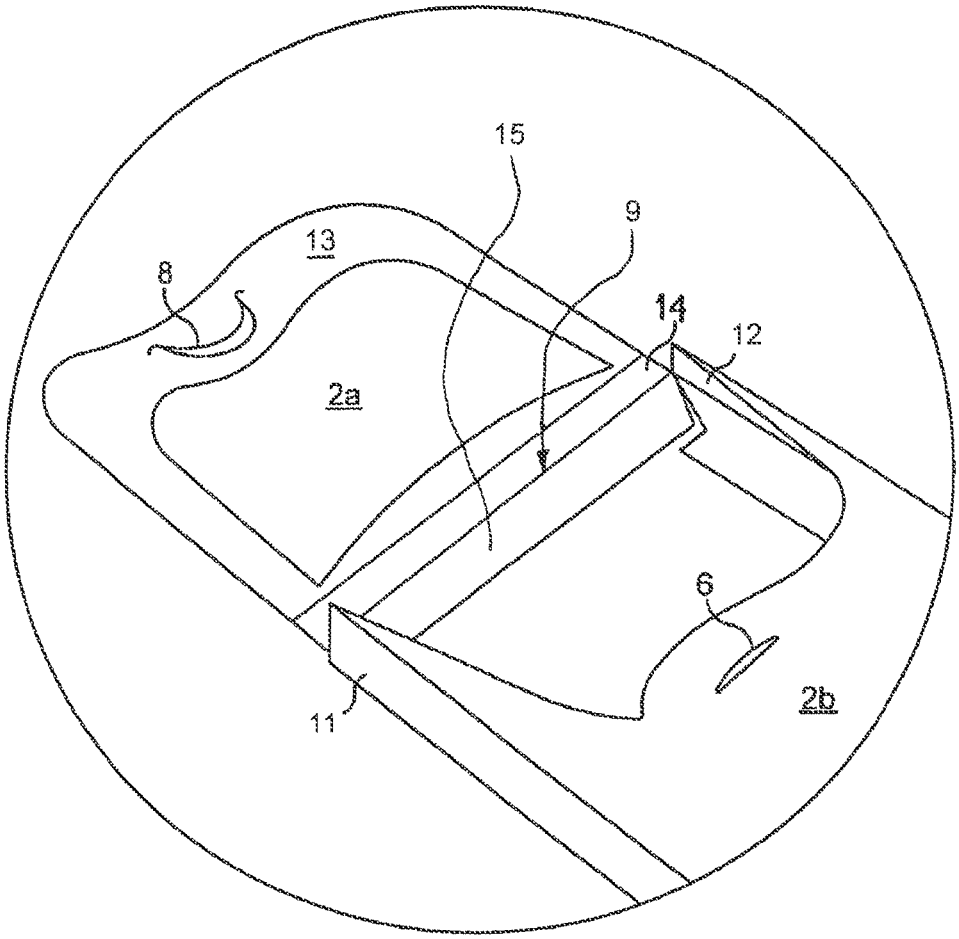
FIG. 5 is a perspective schematic enlarged view, similar to FIG. 4, the package being in its open position.

As can be seen in FIG. 5, the openable portion 2*a* of the front panel is pivotable around the upper edge 9 of the back panel 3, said upper edge 9 acting as a hinge. As further shown in FIG. 5, the locking element 7 comprises a back section 15 overlapping and connected to the back panel 3.

As a result, during the first opening, the consumer lifts the locking element 7 and the openable portion 2*b* of the front panel that are glued together, so as to open the package 1. The openable portion 2*a* is separated from the rest of the front panel 2 along the precuts 5, and the package in open position then appears in the configuration shown in FIG. 5.

To reclose the package 1, the consumer pivots the locking element 7 around the edge 9 and over the non-openable portion 2*b* of the front panel, and then places the tongue portion 8 of the locking element 7 into the locking slot 6 of the non-openable portion 2*b* of the front panel, as shown in FIG. 4.

The filling process for filling a chocolate tablet into a package according to the invention is described hereafter. The main steps are as follows, in order:

1) The naked tablets coming from the chocolate tablet manufacturing process are fed by a conveyor belt into the packaging machine to the first operation where an aluminium foil that comes from a reel is cut in sheets and applied around each tablet;

2) After wrapping around the tablet, the foil is hermitically sealed in three sides (the fourth side is folded only);
3) The tablets wrapped in foil go the next stage (secondary packaging with a carton board);
4) The carton board is provided as pre-cut sheets that are fed into a "magazine";
5) Each carton board sheet is pulled out by grippers from the magazine and hot-melt spots are applied for the final close;
6) The carton board sheet is wrapped around the foiled tablet by means of a the folding system (known in the art), and then glued on each tablet;
7) The tablet secondary packaging (i.e. the carton board) is completed by finishing the gluing process thought an exit plate;
8) The tablets are discharged into the machine exit (lateral brushes).

It is important to note that by using the two-pieces carton board according to the invention—as described hereinbefore—there is no need for any modification of the packaging machine, from the magazine up to the final pack It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A single-layer cardboard package for food products comprising:

a body comprising a front panel, a back panel, a left side panel, a right side panel, and a bottom panel, the front panel comprising precuts, an openable and removeable portion of the front panel, and a non-openable portion of the front panel, the non-openable portion of the front panel comprising a locking slot, the openable and removable portion defined by the precuts and an upper edge of the front panel; and a separate locking element fixed onto the openable portion of the front panel so as to extend a length of the openable portion, the locking element comprising a front section comprising a tongue portion insertable into the locking slot to lock the openable portion in a closed position, the locking element comprising an extension connected to the front section to form a top panel of the package, the locking element comprising a back section connected to the extension, and the back section of the locking element overlaps the back panel of the body to attach the back section to the back panel.

2. The package according to claim 1, wherein the locking element is a cardboard flat panel, and the front section is glued onto the openable and removeable portion of the front panel.

3. The package according to claim 1, wherein the locking element has a width that is equal to a width of the front panel.

4. The package according to claim 1, wherein the package includes a food product comprising a chocolate tablet.

5. A single layer cardboard package comprising:

a body comprising a front panel, a back panel, a bottom panel, a left side panel, and a right side panel, the front panel comprising precuts, an openable and removeable portion, and a non-openable portion, the openable and removable portion defined by the precuts and an upper edge of the front panel;

the non-openable portion of the front panel comprising a locking slot; and a separate locking element located on the openable portion and comprising a front section comprising a tongue insertable into the locking slot to lock the openable portion in a closed position, the locking element forms a top panel of the package, the locking element comprising a back section that overlaps the back panel of the body to attach the back section of the locking element to the back panel.

6. The package according to claim 1, wherein the top panel formed by the extension is adjacent to the openable and removeable portion of the front panel.

7. The package according to claim 1, wherein one side of the top panel is positioned on the upper edge of the front panel, and an opposite side of the top panel is positioned on an upper edge of the back panel the locking element.

8. The package according to claim 1, wherein the locking element consists of the front section, the extension and the back section.

9. The package according to claim 1, wherein the extension is positioned in the locking element between the front section and the back section.

* * * * *